United States Patent [19]

Bone

[11] 4,086,456

[45] Apr. 25, 1978

[54] MOUNTING FOR MAGNETIC SWITCH

[75] Inventor: Kendall Frederick Bone, Cincinnati, Ohio

[73] Assignee: Cincinnati Milacron Inc., Cincinnati, Ohio

[21] Appl. No.: 729,297

[22] Filed: Oct. 4, 1976

[51] Int. Cl.[2] ..... H01H 35/38

[52] U.S. Cl. ..... 200/82 E; 200/82 R; 200/294; 200/303; 200/47

[58] Field of Search ..... 200/82 R, 82 C, 82 D, 200/82 E, DIG. 6, 153 R, 153 T, 47, 50 R, 293, 294, 303, 286, 307, 61.41; 248/214

[56] References Cited

U.S. PATENT DOCUMENTS 3,433,907 3/1969 Day ..... 200/293

3,739,920 6/1973 Coblentz ..... 248/214

OTHER PUBLICATIONS

Advance Automation Cylinders, Adv. Automation Co., Inc., 3526 Elston Ave., Chicago, Ill., SR/LS-676.

*Primary Examiner*—Gerald P. Tolin
*Attorney, Agent, or Firm*—James D. Liles

[57] ABSTRACT

A hydraulic cylinder with heads on each end of a cylinder body utilizes a tie rod of hexagonal cross section to positively prevent relative rotation with an attached magnetic switch. The switch is engaged along the tie rod about a section in which the diametral dimension is at a relative minimum and has mated flattened portions which cooperate with flattened surfaces on the tie rod.

9 Claims, 3 Drawing Figures

MOUNTING FOR MAGNETIC SWITCH

SUMMARY OF THE INVENTION

The invention relates to an air or hydraulic cylinder and more particularly to a cylinder with a magnetic switch activated by a magnet attached to an axially movable piston within a cylinder body. The cylinder body and piston are both constructed of nonmagnetic materials. Heads attached at each end of the cylinder body, are connected by tie rods, at least one of which is non-circular in cross section and preferably has a varying diametral dimension. The magnetic switch is attached to one of these tie rods and contains complimentary surfaces for engagement with the rod at a location in which the diametral dimension is at a relative minimum. Engagement of the switch to these areas of reduced diameter provides a positive means to prevent relative rotation between the switch and the tie rod. Conventional means are also employed to prevent axial movement of the magnetic switch relative to the tie rod. Fluid pressure introduced through the cylinder heads axially moves the piston within the cylinder body and the movement of the magnet, attached to the piston, creates a varying magnitude of magnetic flux which opens and closes the magnetic switch secured to the tie rod.

BACKGROUND

In the use of air and hydraulic cylinders, it has been found that magnetic switches typically magnetic reed switches may be substituted for mechanical limit switches. The reed switch opens and closes in response magnetic flux. This flux is generally produced by a permanent magnet which is attached to a piston within the cylinder body. Movement of the piston, and consequently the magnet, varies the magnetic flux and opens and closes the associated reed switch. Limit switches of this type are in widespread use and have an almost infinite number of potential applications. They may be used for automatic cylinder cycling, light indication, cylinder programming and sequencing, grip timers and counters, multi-position signalling and countless other applications. Their use frequently permits the elimination of auxiliary gears, spiral rod extensions, switch dogs, mounting plates, cams as well as many other elements.

Prior art devices have attached these magnetic switches to tie rods juxtaposed to the cylinder body. These devices, however, experience failures. One type of failure results from high speed operations of the piston in which the resonance time of the requisite level of magnetic flux is insufficient to activate the magnetic switch. This problem is compounded as the cylinder is subjected to various mechanical vibrations. These vibrations tend to cause relative rotation between the magnetic switch and the tie rod to which it is secured. This relative rotation increases the air gap between the switch and a magnet and diminishes the magnitude of magnetic flux experienced by the switch as the magnet passes. The prior art devices have used tie rods of circular cross section and relied upon frictional forces exerted upon a tie rod positioned between the switch housing and an associated fastening plate to prevent relative rotation. Some prior art devices have even provided serrations upon the fastening plate. The result however has been unsatisfactory. The applicant has found that substantial improvement in reliability results from further reducing the probability of relative rotation between the tie rod and the magnetic switch and minimizing the air gap between the magnet and switch. It has further been found that substantial reductions in the probability of relative rotation between the switch and tie rod may be had by cooperating mated flat surface portions on the tie rod and switch or by tightly engaging the switch at a location in which the diametral dimension is at a relative minimum.

It shall therefore be an object of this invention to provide a more reliable magnetic switch.

It is a further object of this invention to provide a positive means on the cylinder tie rod to prevent relative rotation with an attached magnetic switch.

DESCRIPTION OF THE PREFERRED EMBODIMENT

Figure 1:
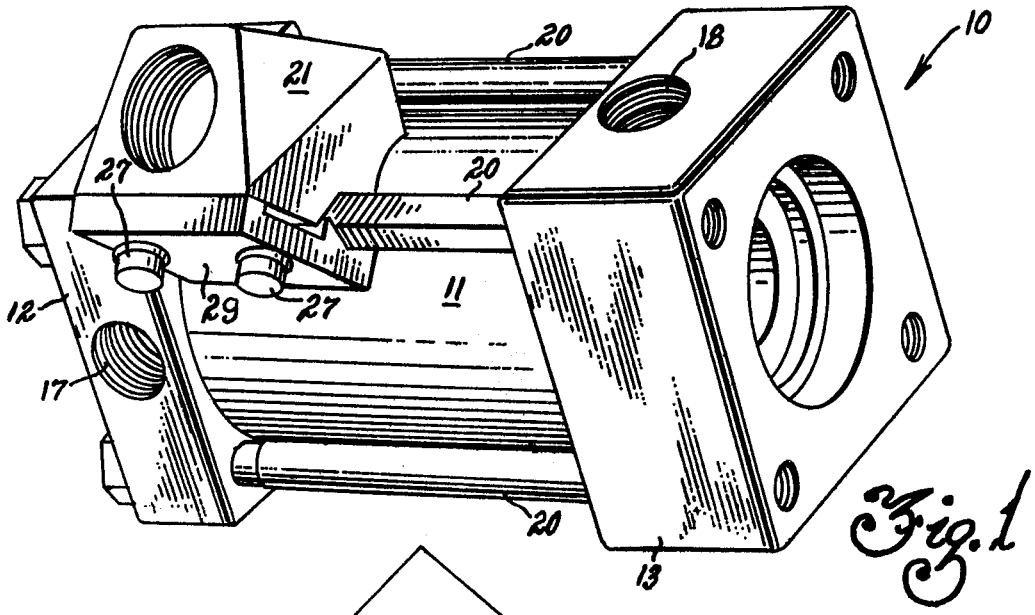
FIG. 1 is a perspective view of a hydraulic cylinder employing one embodiment of the invention.

Referring to FIG. 1, an air or hydraulic cylinder 10 has a cylinder body 11 constructed of aluminum of other nonmagnetic material. Heads 12,13 are secured to each end of the cylinder body 11 and contain openings 17 and 18 which are in fluid communication with the interior portion of the cylinder body 11. A piston 14 (FIG. 3) is axially movable within the cylinder body 11 in response to fluid pressure selectively transmitted through one of the openings 17,18 of the respective heads 12,13. The heads 12,13 are secured to the end of the cylinder body 11 by tie rods 20.

Figure 3:
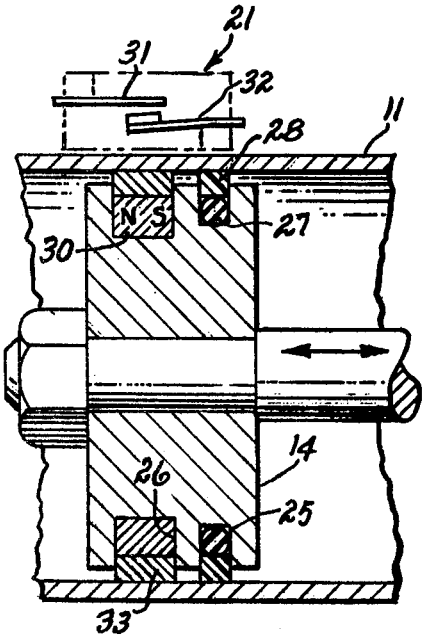
FIG. 3 is a schematic illustration of the relationship of the axially movable piston, magnet and magnetic switch.

As shown schematically in FIG. 3, the piston 14 contains two annular slots 25 and 26 about its periphery. The slot 25 contains an O-ring 27 and a urethane slipper seal 28. Annular slot 26 contains a magnet 30 which is itself circumscribed by an annular slipper bearing 33. A reed switch 21, shown in an open position for clarity, has two reed members 31,32. These reed members open and close in response to a magnetic flux which varys in magnitude as the magnet 30 is passed under the reeds 31,32. The reed switch 21 may be either normally open or normally closed.

Figure 2:
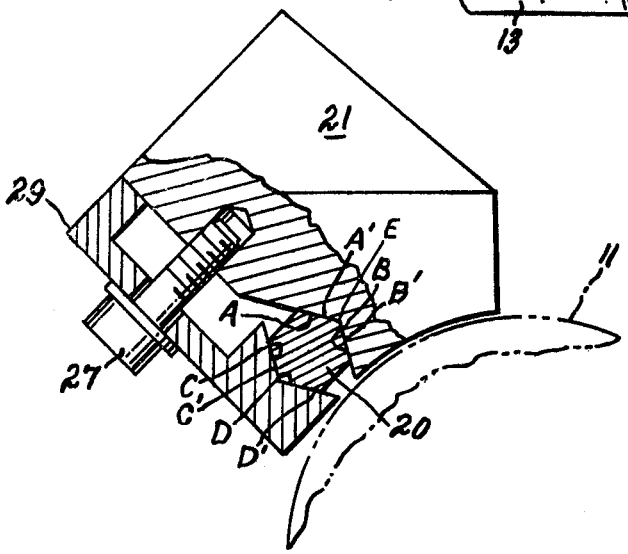
FIG. 2 is a cross-section of the cylinder of FIG. 1 illustrating the attachment of a magnetic switch upon a tie rod.

Referring now to FIG. 2, at least one of the tie rods 20 is non-circular in cross section, preferably of varying diametral dimension, and is shown supporting the reed switch 21. Both the reed switch 21 and its associated fastening plate 29 are shown with flat portions A,B,C and D which respectively engage complimentary flat surfaces A', B', C' and D' of the tie rod 20. The fastening plate 29 is tightly secured to switch 21 by screws 27 and tightly engages the tie rod 20 therebetween. The tightening of screws 27 also prevents axial movement of the switch 21 upon the tie rod 20. As clearly shown in FIG. 2, both the reed switch 21 and its associated fastening plate 29 have adjacent flat surface portions (A and B and C and D, respectively). These surfaces engage mated adjacent surfaces A', B', and C' and D' on the tie rod 20. This arrangement has a twofold significance. First, the cooperating mated flat surface portions of the tie rod 20 and switch 21 provide positive means for preventing relative rotation. Additionally, the tie rod dimension between opposed gripping surfaces A and D, as well dimension between surfaces B and C, is at a relative minimum. In other words, relative rotational movement between the switch and tie rod in either direction would require a greater separation between the switch 21 and the associated fastening plate 29 than that which exists in the tightened mated position. Consequently, relative rotation is prevented when the fastening plate 29 is securely tightened to the switch 21 as the tie rod 20 has a greater cross sectional dimension about the peaks E representing the interface between adjacent flat portions on the tie rod 20. The hexagonal cross sectional area is particularly advantageous in that it provides a multiplicity of flattened surfaces in which the diametral dimension between opposite surfaces is at a relative minimum. It will be readily appreciated, however, that many other cross sections may be utilized with advantageous results, as for example, a rectangular or truncated circular cross section.

What is claimed is:

1. In a cylinder assembly for use in a fluid pressure system, said cylinder assembly having a cylinder body, a head secured to each end of the cylinder body, a piston axially movable within the body in accordance to fluid pressure applied through one of the heads and a magnetic switch for detecting relative position between the piston and cylinder body wherein the improvement comprises:

a tie rod securing a fluid seal between the heads and the cylinder body extending between the heads on each end of the cylinder in juxtapositional relationship to said cylinder body, said tie rod having a non-circular cross-section of varying diametral dimension;

a first gripping surface upon the magnetic switch, said first gripping surface engaging said tie rod to intimately position the switch with respect to the cylinder;

a fastening plate having a second gripping surface engaging the tie rod and positioned thereon such that the cross-sectional dimension of the tie rod between the gripping surfaces is at a relative minimum;

means for selectively reducing the distance between the gripping surfaces and simultaneously compressing the tie rod with the gripping surfaces.

2. A cylinder as recited in claim 1 wherein said tie rod is hexagonal in cross-section.

3. A cylinder as recited in claim 2 wherein said securing means engages said tie rod at a location in which the cross sectional diametral dimension is at a relative minimum.

4. A cylinder as recited in claim 1 wherein said reducing and compressing means includes a screw for tightly securing the fastening plate to the switch.

5. A cylinder as recited in claim 4 wherein both said tie rod and said engaging means have a plurality of flattened surfaces and the plurality of flattened surfaces on said engaging means engage the plurality of surfaces on said tie rod.

6. A cylinder as recited in claim 4 wherein said tie rod, said switch and said fastening plate each have a plurality of flattened surfaces and the plurality of flattened surfaces upon said switch and fastening plate engage the plurality of flat surfaces upon the tie rod.

7. In a cylinder assembly for use in a fluid pressure system, said cylinder assembly having a non-magnetic cylinder body, a head secured to each end of the cylinder body and a piston axially movable within the cylinder body in accordance to fluid pressure applied through one of the heads, the piston including at least a portion of magnetic material, a switch mounting wherein the improvement comprises:

a tie rod securing a fluid seal between the heads and the cylinder body extending between the heads on each end of the cylinder in juxtapositional relationship to the cylinder body, said tie rod having at least one flattened surface portion and a varying diametral cross-sectional dimension;

a magnetic switch positioned on said tie rod to experience a varying magnitude of magnetic flux as the piston is axially moved in the cylinder body, the switch having a first gripping surface engaging said tie rod;

a fastening plate having a second gripping surface cooperating with the first gripping surface to seize the tie rod therebetween, at least one of the gripping surfaces engaging the tie rod upon the flattened surface portion; and means for reducing the distance between the gripping surfaces and simultaneously compressing the tie rod with the gripping surfaces.

8. A cylinder as recited in claim 7 wherein said reducing and compressing means includes a screw for tightly securing the fastening plate to the switch.

9. A cylinder as recited in claim 8 wherein said reducing and compressing means includes a screw for tightly securing the fastening plate to the switch.

* * * * *